US010823364B2

(12) United States Patent
Kumagai et al.

(10) Patent No.: US 10,823,364 B2
(45) Date of Patent: Nov. 3, 2020

(54) VEHICULAR LAMP

(71) Applicant: STANLEY ELECTRIC CO., LTD., Tokyo (JP)

(72) Inventors: Kotaro Kumagai, Tokyo (JP); Hidetaka Okada, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/517,098

(22) Filed: Jul. 19, 2019

(65) Prior Publication Data

US 2020/0025352 A1 Jan. 23, 2020

(30) Foreign Application Priority Data

Jul. 20, 2018 (JP) ..... 2018-136933

(51) Int. Cl.

| | |
|---|---|
| ***F21S 43/20*** | (2018.01) |
| ***F21S 43/40*** | (2018.01) |
| ***F21Y 115/10*** | (2016.01) |
| ***F21W 103/10*** | (2018.01) |

(52) U.S. Cl.

CPC ..... *F21S 43/26* (2018.01); *F21S 43/40* (2018.01); *F21W 2103/10* (2018.01); *F21Y 2115/10* (2016.08)

(58) Field of Classification Search

CPC ... B60Q 1/00; F21S 43/14; F21S 43/15; F21S 43/26; F21S 43/40; F21S 43/237; F21S 41/148; F21S 41/147; F21S 43/251; F21Y 2103/10; F21Y 2115/10; F21W 2103/10

See application file for complete search history.

(56) References Cited

U.S. PATENT DOCUMENTS

| | | | | |
|---|---|---|---|---|
| 7,419,287 | B2 * | 9/2008 | Gasquet | F21V 5/045 362/511 |
| 7,497,605 | B1 * | 3/2009 | Pan | F21S 48/2218 362/487 |
| 8,974,101 | B2 * | 3/2015 | Koizumi | F21S 43/14 362/522 |
| 10,088,118 | B2 * | 10/2018 | Naron | F21S 43/14 |

(Continued)

FOREIGN PATENT DOCUMENTS

| | | | | |
|---|---|---|---|---|
| JP | 2014-086333 | * | 5/2014 | F21S 8/10 |
| JP | 2017-112037 A | | 6/2017 | |

*Primary Examiner* — Peggy A Neils

(74) *Attorney, Agent, or Firm* — Kenealy Vaidya LLP

(57) ABSTRACT

A vehicular lamp includes: light sources; a first condensing optical system that condenses light beams from the light sources; and a second condensing optical system including an incident portion into which the condensed light beams by the first condensing optical system are incident, and an emission portion through which the incident light beams are outputted forward and which has a line-shaped emission surface. The incident portion has a refractive surface that refracts the light beams condensed by the first condensing optical system in a direction in which the light beams are condensed, and the refractive surface refracts the light beams so that condensing points of the light beams condensed by the first condensing optical system fall within a condensing range in which the light beams are outputted from the emission surface even when there is a positional deviation between the first and second condensing optical systems within a set tolerance.

19 Claims, 6 Drawing Sheets

(56) References Cited

U.S. PATENT DOCUMENTS

| | | | | |
|---|---|---|---|---|
| 10,330,274 | B2 * | 6/2019 | Chen | F21V 5/007 |
| 10,578,271 | B1 * | 3/2020 | Chen | F21S 43/249 |
| 10,598,336 | B2 * | 3/2020 | Hanulak | F21S 43/251 |
| 2019/0154228 | A1 * | 5/2019 | Xiang | F21S 43/14 |

* cited by examiner

VEHICULAR LAMP

This application claims the priority benefit under 35 U.S.C. § 119 of Japanese Patent Application No. 2018-136933 filed on Jul. 20, 2018, which is hereby incorporated in its entirety by reference.

TECHNICAL FIELD

The presently disclosed subject matter relates to a vehicular lamp.

BACKGROUND ART

Conventionally, there has been developed a vehicular lamp in which a light source and a lens are used in combination. In such a vehicular lamp, various forms have been developed in accordance with diversified designs (for example, Japanese Patent Application Laid-Open No. 2017-112037).

More specifically, the aforementioned publication discloses a vehicular lamp in which a plurality of light sources are arranged side by side in a width direction, and bundles of light beams emitted radially from the plurality of light sources are condensed by a primary condensing optical system (inner lens) in a vertical direction to be converted into parallel light beams, and then, the parallel light beams are condensed by an incident portion of a secondary condensing optical system (outer lens) in the vertical direction to be outputted from a narrow gap (slit portion) formed in an emission surface thereof, thereby projecting the bundles of light beams in a line shape.

However, in the vehicular lamp described above, since the primary condensing optical system and the secondary condensing optical system are composed of separate components, the positional relationship may vary within a tolerance set in advance. In this case, the positional relationship between the condensing points of respective bundles of light beams to be outputted from the emission surface and the gap (slit portion) formed in the emission surface is also changed (positional deviation), so that the appearance may deteriorate when the bundles of light beams are outputted through the emission surface in a line shape. In particular, as the gap (slit portion) formed in the emission surface becomes narrower, the deterioration of the appearance due to the positional deviation becomes more remarkable.

SUMMARY

The presently disclosed subject matter was devised in view of these and other problems and features in association with the conventional art. According to an aspect of the presently disclosed subject matter, there can be provided a vehicular lamp capable of outputting light with a good appearance even when the emission surface is narrow.

According to another aspect of the presently disclosed subject matter, a vehicular lamp can include: a plurality of light sources arranged side by side in a first direction; a first condensing optical system which is provided corresponding to the light sources and configured to condense respective bundles of light beams emitted from the light sources in a second direction orthogonal to the first direction; and a second condensing optical system including an incident portion on which the respective bundles of light beams condensed by the first condensing optical system are incident, and an emission portion through which the respective bundles of light beams incident on the incident portion are outputted forward. In this vehicular lamp, the incident portion has a refractive surface configured to refract the respective bundles of light beams condensed by the first condensing optical system in a direction in which the respective bundles of light beams are condensed, the emission portion has a line-shaped emission surface extending in the first direction, and the refractive surface refracts the respective bundles alight beams so that condensing points of the respective bundles of light beams condensed by the first condensing optical system fall within a condensing range in which the respective bundles of light beams are outputted from the emission surface even when there is a positional deviation of the first condensing optical system relative to the second condensing optical system within a set tolerance.

In the vehicular lamp according to the foregoing aspect, in another aspect, the emission surface may have a width of 0.5 to 5.0 mm in the second direction (orthogonal to the first direction).

In the vehicular lamp according to any of the foregoing aspects, in another aspect, the refractive surface may be composed of a convex free-curved surface in a cross section in the second direction (orthogonal to the first direction). Alternatively, in another aspect, the refractive surface may be composed of a pair of refractive surfaces inclined in opposite directions across a top thereof in a cross section in the second direction (orthogonal to the first direction).

In the vehicular lamp according to any of the foregoing aspects, in another aspect, the second condensing optical system may have a pair of reflecting surfaces inclined in opposite directions across the emission surface in a cross section in the second direction (orthogonal to the first direction).

In the vehicular lamp according to any of the foregoing aspects, in another aspect, the second condensing optical system may include a diffusing, portion configured to diffuse the bundles of light beams condensed by the first condensing optical system in the first direction.

The vehicular lamp according to any of the foregoing aspects, in another aspect, may include an extension member configured to cover the second condensing optical system on a front surface side thereof excluding the emission surface.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicular lamps of the presently disclosed subject matter with reference to the accompanying drawings in accordance with exemplary embodiments.

In the accompanying drawings, the XYZ orthogonal coordinate system is set, and the X-axis direction is indicated as the front-rear direction (lengthwise direction) of the vehicular lamp, the Y-axis direction is indicated as the left-right direction (widthwise direction) of the vehicular lamp, and the Z-axis direction is indicated as the vertical direction (height direction) of the vehicular lamp.

As an exemplary embodiment of the present invention, for example, a vehicular lamp 1 illustrated in FIGS. 1 to 4 will be described.

Figure 1:
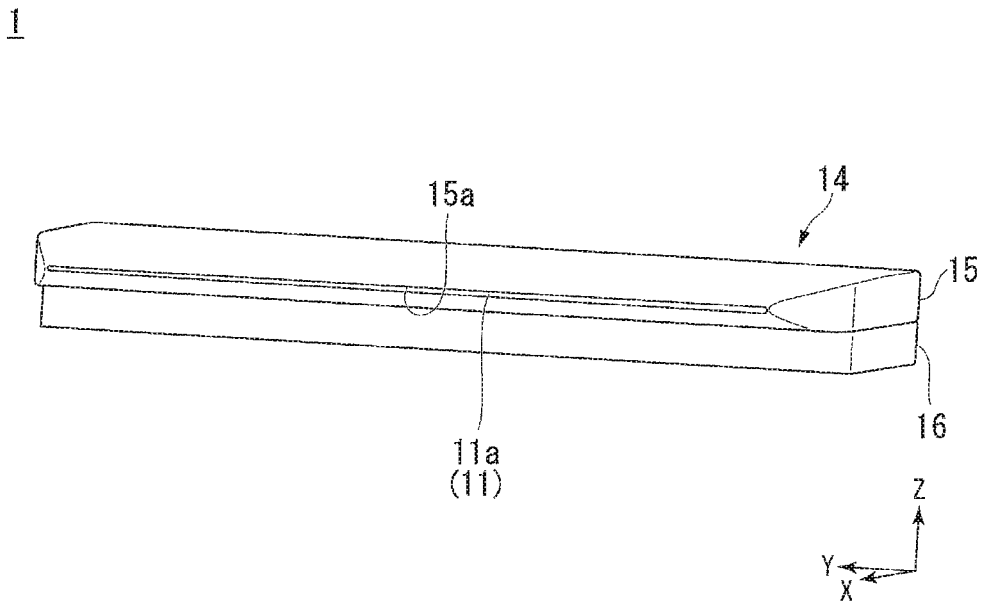
FIG. 1 is a perspective view illustrating an appearance of a vehicular lamp according to an exemplary embodiment made in accordance with principles of the presently disclosed subject matter.
Figure 2:
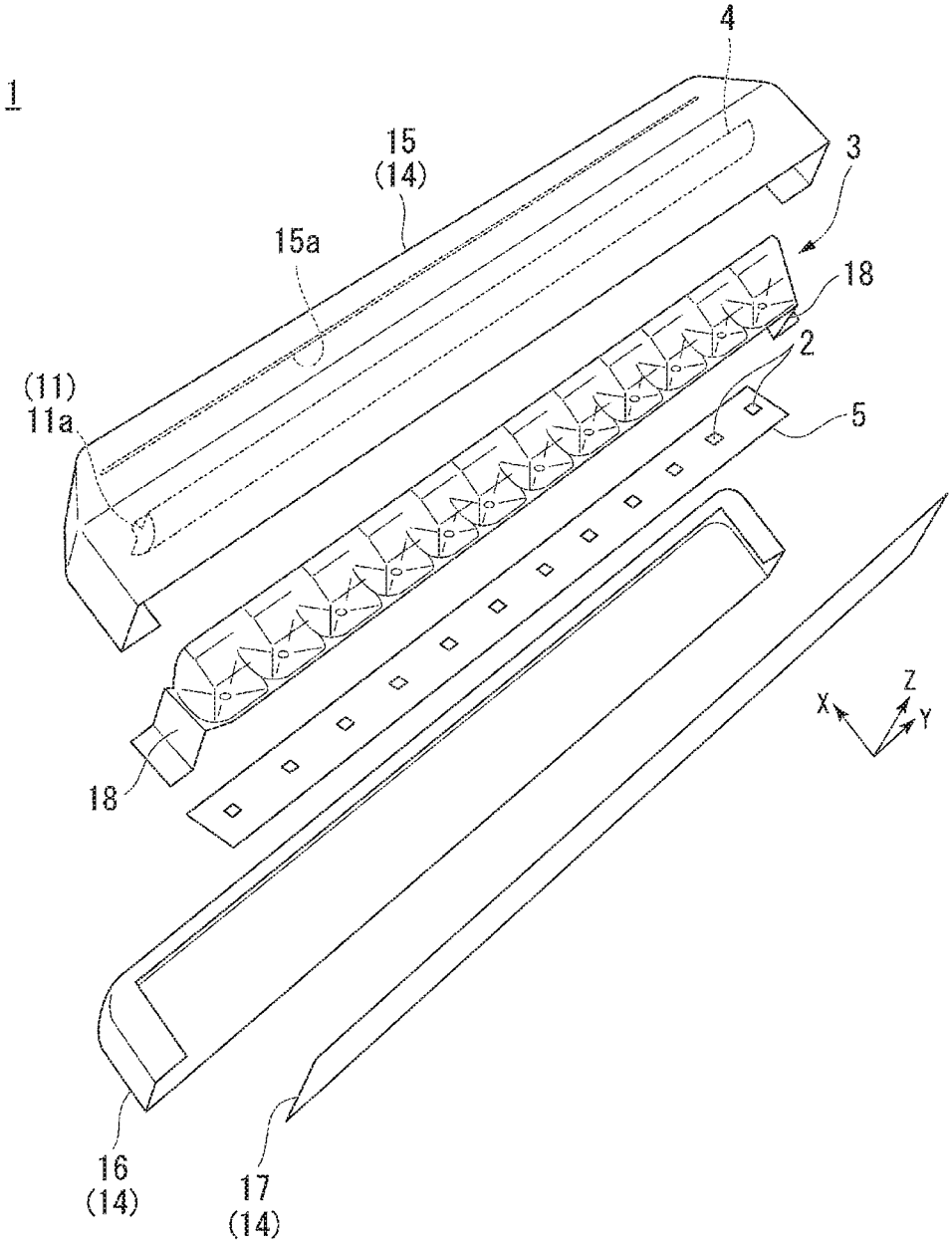
FIG. 2 is an exploded perspective view illustrating the configuration of the vehicular lamp illustrated in FIG. 1.
Figure 3:
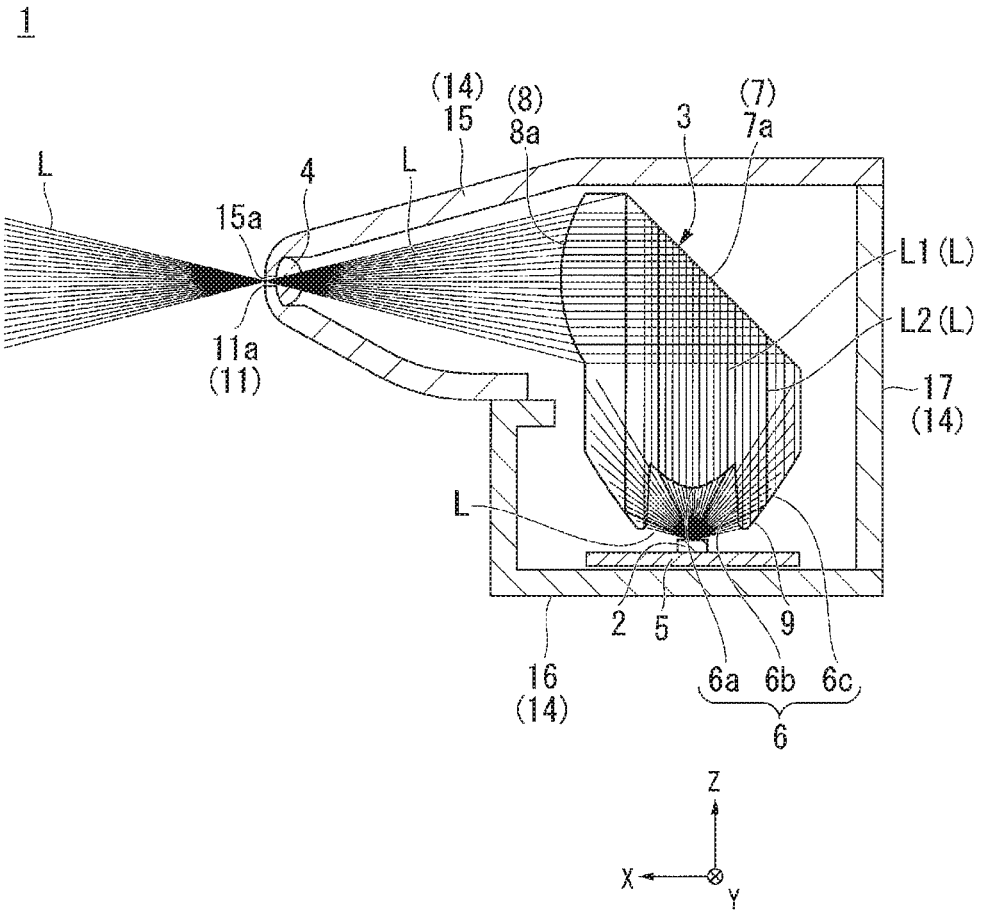
FIG. 3 is a cross-sectional view illustrating the configuration of the vehicular lamp illustrated in FIG. 1.
Figure 4:
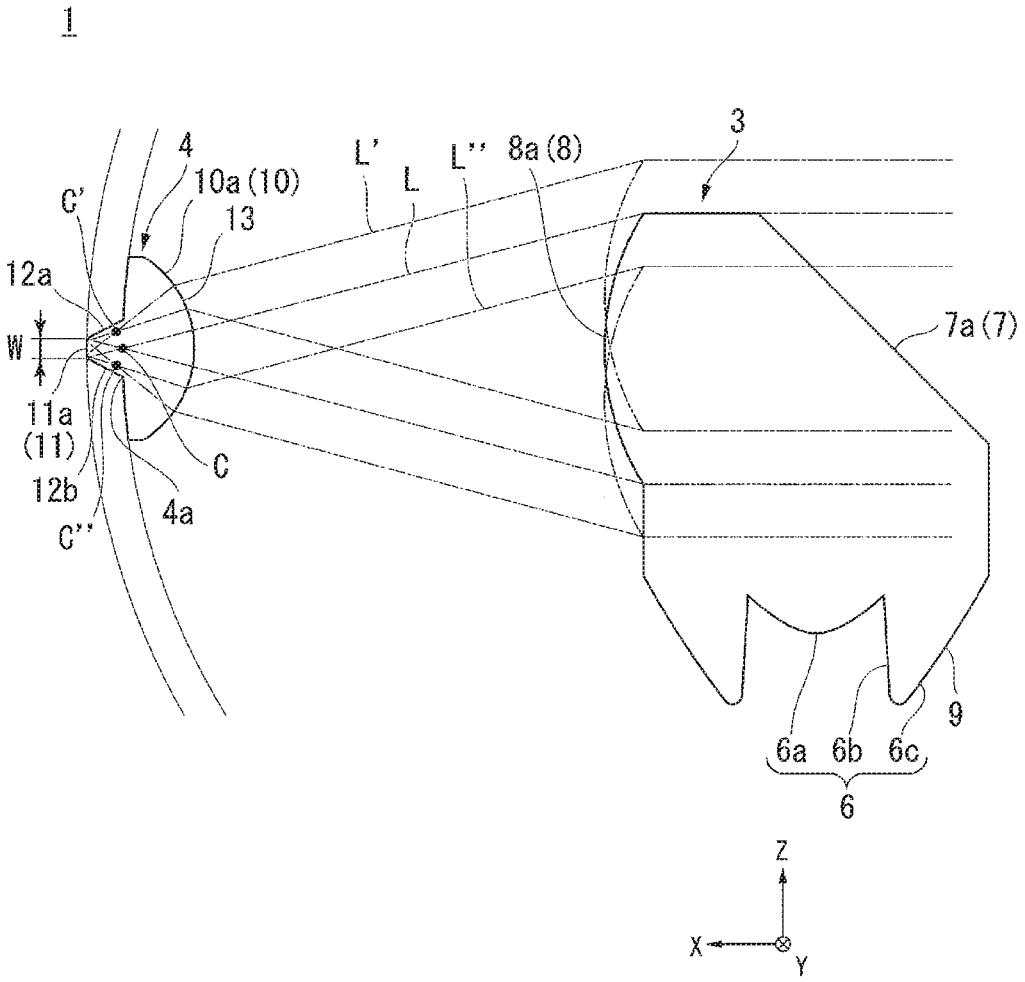
FIG. 4 is a schematic diagram illustrating the optical path of the vehicular lamp illustrated in FIG. 1.

FIG. 1 is a perspective view illustrating the appearance of the vehicular lamp 1, FIG. 2 is an exploded perspective view illustrating the configuration of the vehicular lamp 1. FIG. 3 is a cross-sectional view illustrating the configuration of the vehicular lamp 1. FIG. 4 is a schematic diagram illustrating the optical path of bundles of light beams L of the vehicular lamp 1.

In the vehicular lamp 1 of the present exemplary embodiment, the presently disclosed subject matter is applied to a vehicle width indicator (position lamp) to be mounted on both corner portions on the front end side of a vehicle body (not shown), for example (a corner portion on the left front end side in the present exemplary embodiment).

Specifically, the vehicular lamp 1 includes a plurality of light sources 2, a first inner lens (first condensing optical system) 3, and a second inner lens (second condensing optical system) 4.

The plurality of light sources 2 are LEDs that emit white light L. The LEDs may be high-power (high-luminance) LEDs such as SMD LEDs for use in vehicular illumination. The plurality alight sources 2 are mounted on a circuit board 5 on the upper surface side thereof and arranged in a horizontal direction (Y-axis direction or first direction) at regular intervals. The circuit board 5 may be provided with a drive circuit configured to drive the LEDs. With this configuration, each of the light sources 2 can emit a bundle of light beams L radially upward in the +Z-axis direction.

In the present exemplary embodiment, the plurality of LEDs (light sources 2) are mounted on the above-described circuit board 5. In another aspect, a substrate (mounting board) on which a plurality of LEDs are mounted and a substrate (circuit board) on which a driving circuit is provided may be separately arranged, and the mounting board and the circuit board may be electrically connected via a wiring cord called a harness, so that the driving circuit can be protected from heat generated by the plurality of LEDs.

The first inner lens 3 is formed of a light guide body having a shape extending in the horizontal direction (Y-axis direction) as a whole corresponding to the plurality of light sources 2. The light guide body may be made of a material having a refractive index higher than that of air, such as a resin or glass transparent to the light beams L emitted from the respective light sources 2. Examples thereof may include glass, a polycarbonate resin, and an acrylic resin.

The first inner lens 3 has first incident portions 6, first reflection portions 7, and first emission portions 8 provided corresponding to the respective light sources 2 as a plurality of sets. The first inner lens 3 has a structure in which the plural sets of the first incident portion 6, the first reflection portion 7, and the first emission portion 8 are provided side by side in the extension direction (Y-axis direction) of the first inner lens 3.

The first incident portions 6 are located on the lower surface side of the first inner lens 3, and are provided so as to face the respective light sources 2 correspondingly. Hereinafter, one of them is focused on for description of the detailed structure. The first incident portion 6 includes a first condensing incident surface 6*a*, a second condensing incident surface 6*b*, a condensing reflecting surface 6*c*, and a protruding portion 9 defined between the surfaces 6*b* and 6*c*. The first condensing incident surface 6*a* has a convex shape and is located at the center of the portion facing the corresponding light source 2, so that a portion of the light beams L emitted from the light source 2 (hereinafter, referred to as first light (beams) L1) is incident thereon. The second condensing incident surface 6*b* is located on the inner peripheral side of the protruding portion 9 protruding toward the light source 2 side from a position surrounding the periphery of the first condensing incident surface 6*a*, so that a portion of the light beams L emitted from the light source 2 (hereinafter, referred to as second light (beams) L) is incident thereon. The condensing reflecting surface 6*c* is located on the outer peripheral side of the protruding portion 9, so that the second light L2 having been incident on the second condensing incident surface 6*b* is reflected to the first reflection portion 7.

In the first incident portion 6, of the light beams L emitted from the light source 2, the first light beams L1 having entered through the first condensing incident surface 6*a* are condensed toward the first reflecting section 7 while being close to the optical axis of the light source 2. On the other hand, by reflecting the second light beams L2 having entered through the second condensing incident surface 6*b* by the condensing reflecting surface 6*c*, the second light beams L2 are condensed toward the first reflection portion 7 while being close to the optical axis. As a result, the bundles of light beams L having entered the first inner lens 3 through the first incident portion 6 are guided toward the first reflection portion 7 while being collimated or condensed. In the present exemplary embodiment, the light beams L are collimated.

The first reflection portion 7 is located on the upper surface side of the first inner lens 3 and has a first reflecting surface 7*a* facing the first incidence portion 6. The first reflecting surface 7*a* is formed of an inclined surface inclined toward the first emission portion 8. The first reflecting surface 7*a* is continuously provided in the extension direction (Y-axis direction) of the first inner lens 3.

In the first reflection portion 7, the bundles of light beams L guided inside the first inner lens 3 are reflected by the first reflecting surface 7*a* toward the first emission portion 7. As a result, the bundles of light beams L reflected by the first reflecting surface 7*a* are guided toward the first emission portion 8 while the light beams are maintained to be parallel to one another.

The first emission portion 8 is located on the front surface side of the first inner lens 3 and has a first emission surface 8*a* facing the first reflecting surface 7*a*. The first emission surface 8*a* is formed of a lens surface that is convexly curved toward the front (in the +X-axis direction) in the vertical cross section of the first inner lens 3.

In the first emission portion 8, the bundles of light beams L reflected by the first reflecting surface 7*a* are outputted from the first emission surface 8*a* to the outside of the first inner lens 3. In this case, in the first emission portion 8, the bundles of light beams L having been incident on the first emission surface 8*a* are outputted toward the front second inner lens 4 while being condensed in the up-down direction (vertically).

The second inner lens 4 is formed of a light guide body having a shape extending in the horizontal direction (Y-axis direction) as a whole (see FIG. 2). The second inner lens 4 may be made of the same material as that of the light guide body exemplified for the first inner lens 3 described above.

The second inner lens 4 has a second incident portion 10 on which the respective bundles of light beams L condensed by the first inner lens 3 are incident, and a second emission portion 11 through which the respective bundles of light beams L having entered through the second incident portion 10 are outputted forward. The second inner lens 4 has a structure in which the second incident portion 10 and the second emission portion 11 are continuously provided (extended) in the extension direction (Y-axis direction) of the second inner lens 4.

The second incident portion 10 has a refractive surface 10*a* located on the rear surface side of the second inner lens 4. The refractive surface 10*a* is formed of a free-curved surface (aspherical surface) convexly curved toward the rear (−X-axis direction) in the vertical cross section of the second inner lens 4. The top of the refractive surface 10*a* is located at the center in the vertical direction on the rear surface side of the second inner lens 4.

In the second incident portion 10, the respective bundles of light beams L condensed by the first inner lens 3 are refracted by the refractive surface 10*a* in a direction in which the light beams L are condensed in the vertical direction. As a result, the respective bundles of light beams L having entered through the second incident portion 10 into the second inner lens 4 are guided toward the second emission portion 11 while being condensed in the vertical direction.

The second emission portion 11 is located at the center portion in the vertical direction on the front surface side of the second inner lens 4, and has a line-shaped second emission surface 11*a* extending in the extension direction of the second inner lens 4. The width W of the second emission surface 11*a* in the vertical direction is 0.5 to 5.0 mm, more preferably 0.5 to 3.0 mm. The width W of the second emission surface 11*a* is smaller than the width of the refractive surface 10*a* in the vertical direction.

The second emission surface 11*a* is formed of a lens surface curved convexly toward the front in the vertical cross section of the second inner lens 4. The second emission surface 11*a* is not limited to the case where the curved lens surface is configured as described above, but may be configured with a plane surface.

In the second emission portion 11, the bundles of light beams L guided inside the second inner lens 4 are outputted from the second emission surface 11*a* to the outside of the second inner lens 4. In the second emission portion 11, the bundles of light beams L having been incident on the second emission surface 11*a* are outputted forward while being condensed in the vertical direction. Thus, the second emission surface 11*a* constitutes a light emission surface that projects light beams L outputted through the second emission surface 11*a* in a line shape.

The second inner lens 4 has, in its vertical cross section, a pair of second reflection surfaces 12*a* and 12*b* inclined in opposite directions with the second emission surface 11*a* interposed therebetween. Thus, the second inner lens 4 has a shape gradually narrowing toward the second emission surface 11*a* between the second reflection surfaces 12*a* and 12*b*.

That is, the second inner lens 4 has a protruding portion 4*a* protruding forward from the center portion on the front surface side thereof. The protruding portion 4*a* has a shape that gradually narrows toward the distal end of the protruding portion. The second emission surface 11*a* is formed by the distal end surface of the protruding portion 4*a*. Thus, the second reflecting surfaces 12*a* and 12*b* are composed of upper and lower surfaces of the protruding portion 4*a*, respectively.

In the second inner lens 4, the light beams L incident on the second reflection surfaces 12*a* and 12*b* are reflected toward the second emission surface 11*a*. As a result, the light beams L reflected by the second reflecting surfaces 12*a* and 12*b* can be guided to the second emission surface 11*a*, in addition to the light beams L that have entered from the second incident portion 10 into the second inner lens 4 and directly travelled to the second emission surface 11*a*.

The second inner lens 4 may have a diffusion portion 13 configured to diffuse the respective bundles of light beams L condensed by the first inner lens 3 in the horizontal direction. The diffusion portion 13 is located on the front surface side or the rear surface side of the second inner lens 4 (on the rear surface side in this exemplary embodiment), and has an irregular structure configured to diffuse the bundles of light beams L incident on the rear surface in the horizontal direction.

Examples of such an irregular structure may include a lens cut called a flute cut or fish-eye cut, and irregular structures formed by a knurling processing, a grain processing, or the like. In the diffusion portion 13, it is possible to control the degree of diffusion of the light beams L outputted from the second emission surface 11*a* by adjusting the shape and the like of the diffusion portion 13.

The vehicular lamp 1 of the present exemplary embodiment includes an extension 14 which is an aesthetic component. In the vehicular lamp 1, the provision of such an extension 14 in a lamp body (not shown) can decorate the front side of the vehicular lamp 1 to enhance the aesthetic properties of the vehicular lamp 1.

Specifically, the extension 14 has an extension member 15 constituting a front face, both side faces, and an upper face thereof; a base stand 16 constituting a front face, both side faces, and a bottom face side thereof; and a back panel 17 constituting a back face (rear face) thereof.

Of these, the extension member 15 is made of an opaque synthetic resin molded body formed in a long box shape as a whole, and its surface constitutes a silver mirrored surface by aluminum deposition. On the other hand, the base stand 16 and the back panel 17 are made of an opaque resin molded body formed in a long flat plate shape as a whole, and the surface thereof constitutes a black surface painted in black.

The circuit board 5 on which the plurality of light sources 2 are mounted, the first inner lens 3, and the second inner lens 4 are disposed inside the extension 14 composed of the extension member 15, the base stand 16, and the back panel 17.

The circuit board 5 on which the light sources 2 are mounted is disposed on the surface of the base stand 16. The first inner lens 3 is disposed on the surface of the base stand 16 via a support member 18 supporting both ends of the first inner lens 3 so as to be located above the circuit board 5. The second inner lens 4 is located inside the extension member 15 and integrally attached to the distal end of the extension member 15.

The extension member 15 has a slit portion 15*a* corresponding to the second emission surface 11*a*, and is configured to cover the front surface of the second inner lens 4 except for the second emission surface 11*a* by exposing the second emission surface 11*a* from the slit portion 15*a* to the outside. The extension member 15 has a shape in which the distal end side thereof protrudes forward and gradually narrows toward the slit portion 15*a*. As a result, the protruding portion 4*a* of the second inner lens 4 is in a state of being inserted inside the slit portion 15*a*. The second emission surface 11*a* of the second inner lens 4 (the distal end surface of the protruding portion 4*a*) is flush with the distal end of the extension member 15.

In the vehicular lamp 1 of the present exemplary embodiment having the above-described configuration, the second light emission surface 11*a* can be made to project the respective bundles of light beams L in a line shape by outputting the respective bundles of light beams L from a narrow gap (slit portion 15*a*) of the second light emission surface 11*a* while condensing the bundles of light beams L emitted from the plurality of light sources 2 by the first inner lens 3 and the second inner lens 4.

Incidentally, in the vehicular lamp 1 of the present exemplary embodiment, the condensing points C of the respective bundles of light beams L emitted forward from the above-mentioned second emission surface 11*a* are located in the vicinity of the second emission surface 11*a*. In the present exemplary embodiment, the condensing points C of the respective bundles of light beams L are located in the vicinity of the center of the proximal end of the protruding portion 4*a*. As a result, the respective bundles of light beams L to be outputted forward from the second emission surface 11*a* pass through the second emission surface 11*a* (pass through the slit portion 15*a*) while diffusing from the condensing points C of the respective bundles of light beams L as they travel forward.

On the other hand, in the vehicular lamp 1 of the present exemplary embodiment, since the first inner lens 3 and the second inner lens 4 are composed of separate components, the positional relationship may vary within a tolerance set in advance. In this case, the positional relationship between the condensing point C of each bundle of light beams L outputted from the second emission surface 11*a* and the gap (slit portion 15*a*) of the second emission surface 11*a* may also be deviated.

In the vehicular lamp 1 of the present exemplary embodiment, the refractive surface 10*a* refracts the respective bundles of light beams L so that the condensing point C of each bundle of light beams L condensed by the first inner lens 3 falls within the condensing range in which each bundle of light beams L is outputted from the second emission surface 11*a* even when there is such a positional deviation of the first inner lens 3 relative to the second inner lens 4 within the tolerance.

Herein, the condensing range is a range in which the condensing points C of the respective bundles of light beams L outputted from the second emission surface 11*a* are located as seen in the vertical cross section of the second inner lens 4, and refers to a range in which the respective bundles of light beams L to be outputted forward from the second emission surface 11*a* can pass through the second emission surface 11*a* while diffusing from the condensing points C of the respective bundles of light beams L (passing through the slit portion 15*a*) as they travel forward.

The refractive surface 10*a* refracts the respective bundles of light beams L in the direction of condensing the light beams L so that the condensing points C of the respective bundles of light beams L condensed by the first inner lens 3 fall within the condensing range with respect to the positional deviation in the vertical direction of the first inner lens 3. The refractive surface 10*a* of the present exemplary embodiment is formed of a free-curved surface (aspherical surface) whose curvature (refractive power) increases from the center toward the outer periphery in the vertical direction.

In this case, of the bundles of light beams L condensed by the first inner lens 3, the bundles of light beams L having no relative positional deviation of the first inner lens 3 with respect to the second inner lens 4 enter the refractive surface 10*a* from the central portion of the refractive surface 10*a*. As a result, while the bundles of light beams L having entered the refractive surface 10*a* are refracted in the condensing direction, the bundles of light beams L are condensed to the condensing points C located in the vicinity of the center on the proximal end side of the protruding portion 4*a* described above.

On the other hand, when the first inner lens 3 is deviated upward relative to the second inner lens 4 (the optical axis of the light beams outputted from the first inner lens 3 is deviated upward from the center in the vertical direction of the second inner lens 4), the bundles of light beams L' enter the refractive surface 10*a* from a position shifted upward from the central portion of the refractive surface 10*a*. As a result, the bundles of light beams L' incident on the refractive surface 10*a* are refracted in the condensing direction, and are condensed to the condensing point C' located at a position shifted forward and upward from the condensing point C described above.

On the other hand, when the first inner lens 3 is deviated downward relative to the second inner lens 4 (the optical axis of the light emitted from the first inner lens 3 is deviated downward from the center in the vertical direction of the second inner lens 4), the bundles of light beams L" enter the refractive surface 10*a* from a position shifted downward from the central portion of the refractive surface 10*a*. As a result, the bundles of light beams L" incident on the refractive surface 10*a* are refracted in the condensing direction, and are condensed to the condensing point C" located at a position shifted forward and downward from the condensing point C described above.

Each of these light condensing points C, C', and C" is located at a position that falls within a light condensing range in which the respective bundles of light beams L, L', and L" are outputted from the second emission surface 11*a*. Therefore, the respective bundles of light beams L, L', and L" to be outputted forward from the second emission surface 11*a* can pass through the second emission surface 11*a* (pass through the slit portion 15*a*) while diffusing from the condensing points C, C', C" of the respective bundles of light beams L, L', L" as they travel forward.

As described above, the vehicular lamp 1 of the present exemplary embodiment can output the respective bundles of light beams L from the narrow gap (slit portion 15*a*) of the second emission surface 11*a*, so that the bundles of light beams L can be uniformly projected through the line-shaped second emission surface 11*a*. Therefore, the vehicular lamp 1 of the present exemplary embodiment can have improved appearance when the second emission surface 11*a* is caused to project light in a line shape.

In the above-described exemplary embodiment, the first inner lens 3 is used as the first condensing optical system, but the presently disclosed subject matter is not limited thereto. For example, instead of the first inner lens 3, first condensing optical systems such as those illustrated in FIGS. 5A to 5C may be adopted.

Figure 5A:
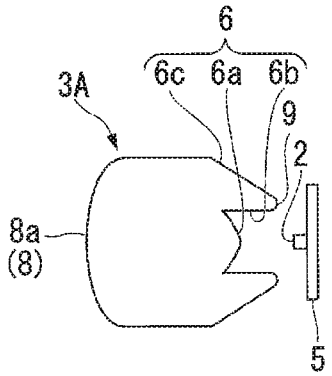
FIGS. 5A to 5C are cross-sectional views illustrating other configuration examples (modifications) of the first condensing optical system included in the vehicular lamp illustrated in FIG. 1.

Specifically, the first condensing optical system 3A as a modification illustrated in FIG. 5A is configured such that the first reflection portion 7 (first reflecting surface 7*a*) is omitted from the first inner lens 3, and the first incident portion 6 is provided on the rear side and the first emission portion 8 is provided on the front side. The circuit board 5 on which the plurality of light sources 2 are mounted is disposed on the rear side of the first inner lens 3A so that the light sources 2 emit the respective bundles of light beams L radially in the forward direction (+X-axis direction).

The first inner lens 3A is configured to collimate or condense the bundles of light beams L emitted from the plurality of light sources 2 that have entered the first inner lens 3A from the first incident portion 6. Then, the bundles of light beams L guided inside the first inner lens 3A are condensed and outputted from the first emission portion 8 toward the second inner lens 4 located in front of the first inner lens 3A (similar to the lens 4 shown FIG. 3 or the like).

Figure 5B:
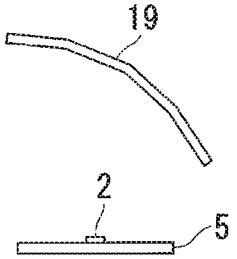

On the other hand, the first condensing optical system as another modification illustrated in FIG. 5B is constituted by a reflector 19 disposed above the circuit board 5. The reflector 19 reflects the bundles of light beams L, emitted upward from the plurality of light sources 2, toward the front second inner lens 4 (similar to the lens 4 shown FIG. 3 or the like) while condensing the bundles of light beams L.

Figure 5C:
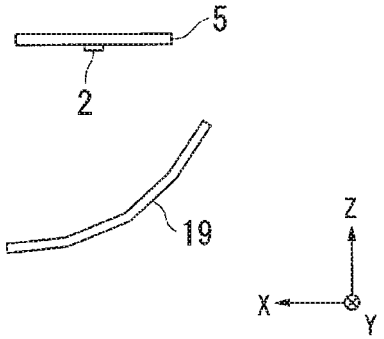

As further another modification, the first condensing optical system illustrated in FIG. 5C is a reflector 19 disposed below the circuit board 5. The circuit board 5 is disposed with the plurality of light sources 2 facing downward. The reflector 19 reflects the bundles of light beams L, emitted downward from the plurality of light sources 2, toward the front second inner lens 4 (similar to the lens 4 shown FIG. 3 or the like) while condensing the bundles of light beams L.

The vehicular lamps 1 that adopts the first inner lens 3A, the reflector 19, or the like as illustrated in FIGS. 5A to 5C instead of the first inner lens 3 described above can also provide improved appearance when the second emission surface 11*a* is caused to project the bundles of light beams in a line shape.

Incidentally, the second reflection surfaces 12*a* and 12*b* are not limited to a shape symmetrical with respect to each other with the second emission surface 11*a* interposed therebetween, and may have a shape asymmetrical with respect to each other.

In the above-described exemplary embodiments, the second inner lens 4 is used as the second condensing optical system, but the presently disclosed subject matter is not limited thereto. For example, instead of the second inner lens 4, second condensing optical systems such as those illustrated in FIGS. 6A to 6C may be adopted.

Figure 6A:
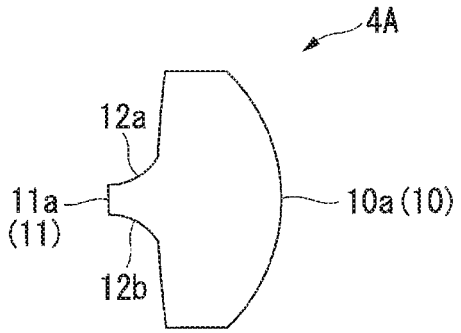
FIGS. 6A to 6C are cross-sectional views illustrating other configuration examples (modifications) of the second condensing optical system included in the vehicular lamp illustrated in FIG. 1.

More specifically, the second condensing optical system 4A as a modification illustrated in FIG. 6A is configured such that the second reflecting surfaces 12*a* and 12*b* of the second inner lens 4 are concavely curved.

Figure 6B:
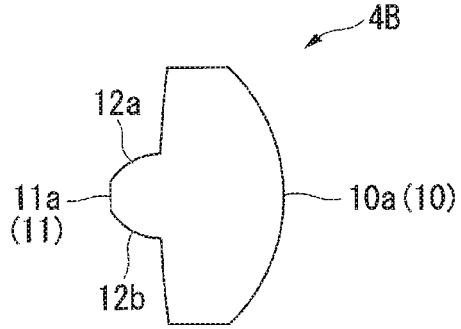

As another modification, the second condensing optical system 4B as a modification illustrated in FIG. 6B is configured such that the second reflecting surfaces 12*a* and 12*b* are convexly curved out of the second inner lens 4 illustrated in FIG. 6B.

Figure 6C:
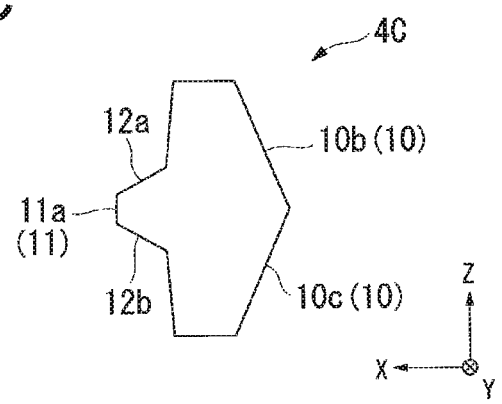

On the other hand, the second condensing optical system 4C illustrated in FIG. 6C is composed of a pair of refractive surfaces 10*b* and 10*c* inclined in opposite directions across the top, instead of the refractive surface 10*a* out of the second inner lens 4.

In any of the second inner lenses 4A, 4B, and 4C illustrated in FIGS. 6A to 6C, the top portion of the curved surface 10*a* (10*b*, 10*c*) is also located at the vertical center portion of the rear surface side of the second inner lens 4. Each of the second inner lenses 4A, 4B, and 4C has a pair of second reflecting surfaces 12*a* and 12*b* inclined in opposite directions with the second emission surface 11*a* interposed therebetween in the vertical cross section.

As a result, the vehicular lamp 1 that adopts the second inner lens 4A, 4B, or 4C as illustrated in FIGS. 6A to 6C instead of the second inner lens 4 can also have improved appearance when the second emission surface 11*a* is caused to project bundles of light beams in a line shape.

In the above-described exemplary embodiments, the vehicular lamp 1 to which the presently disclosed subject matter is applied is adopted as a vehicle width indicator (position lamp), but the presently disclosed subject matter is not limited thereto. In another modification, the present invention can be widely applied to vehicular lamps such as a direction indicator (turn signal lamp) and a daytime lighting lamp (DRL) that emits bundles of light beams in a line shape on the emission surface.

Further, the vehicular lamp to which the presently disclosed subject matter is applied is not limited to the vehicular lamp to be disposed on the front side described above, and the presently disclosed subject matter can be applied to, for example, a direction indicator, a rear side vehicular lamp such as a tail lamp, a brake lamp (stop lamp), or a back lamp, or the like.

As the light source 2, for example, a light-emitting element such as a laser diode may be used in addition to the LED. The color of the light beams L emitted by the light source 2 is not limited to the white light described above, and can be appropriately changed according to the use applications of the vehicular lamp such as red light or orange (amber) light.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicular lamp comprising:

a plurality of light sources arranged side by side in a first direction;

a first condensing optical system which is provided corresponding to the light sources and configured to condense respective bundles of light beams emitted from the light sources in a second direction orthogonal to the first direction; and a second condensing optical system including an incident portion on which the respective bundles of light beams condensed by the first condensing optical system are incident, a protruding portion protruded forward to have a distal end surface and opposed surfaces and provided on a side opposite to the incident portion, and an emission portion through which the respective bundles of light beams incident on the incident portion are outputted forward, wherein the incident portion has a refractive surface configured to refract each of the bundles of light beams condensed by the first condensing optical system in a direction in which each of the bundles of light beams is condensed, the emission portion has a line-shaped emission surface extending in the first direction, the line-shaped emission surface is formed by the distal end surface of the protruding portion, the line-shaped emission surface has a width that is smaller than a width of the refractive surface in a direction orthogonal to the first direction and a light-emitting direction, the refractive surface refracts each of the bundles of light beams so that condensing points of the respective bundles of light beams condensed by the first condensing optical system fall within a condensing range in which the respective bundles of light beams are outputted from the line-shaped emission surface even when there is a positional deviation of the first condensing optical system relative to the second condensing optical system within a set tolerance, and the second condensing optical system has a pair of reflecting surfaces which are composed of the opposed surfaces of the protruding portion and inclined in opposite directions across the line-shaped emission surface in a cross section in the second direction.

2. The vehicular lamp according to claim 1, wherein the emission surface has a width of 0.5 to 5.0 mm in the second direction.

3. The vehicular lamp according to claim 1, wherein the refractive surface is composed of a convex free-curved surface in a cross section in the second direction.

4. The vehicular lamp according to claim 2, wherein the refractive surface is composed of a convex free-curved surface in a cross section in the second direction.

5. The vehicular lamp according to claim 1, wherein the refractive surface is composed of a pair of refractive surfaces inclined in opposite directions across a top thereof in a cross section in the second direction.

6. The vehicular lamp according to claim 2, wherein the refractive surface is composed of a pair of refractive surfaces inclined in opposite directions across a top thereof in a cross section in the second direction.

7. The vehicular lamp according to claim 1, wherein the second condensing optical system includes a diffusing portion configured to diffuse the bundles of light beams condensed by the first condensing optical system in the first direction.

8. The vehicular lamp according to claim 2, wherein the second condensing optical system includes a diffusing portion configured to diffuse the bundles of light beams condensed by the first condensing optical system in the first direction.

9. The vehicular lamp according to claim 3, wherein the second condensing optical system includes a diffusing portion configured to diffuse the bundles of light beams condensed by the first condensing optical system in the first direction.

10. The vehicular lamp according to claim 4, wherein the second condensing optical system includes a diffusing portion configured to diffuse the bundles of light beams condensed by the first condensing optical system in the first direction.

11. The vehicular lamp according to claim 5, wherein the second condensing optical system includes a diffusing portion configured to diffuse the bundles of light beams condensed by the first condensing optical system in the first direction.

12. The vehicular lamp according to claim 1, comprising an extension member configured to cover the second condensing optical system on a front surface side thereof excluding the emission surface.

13. The vehicular lamp according to claim 2, comprising an extension member configured to cover the second condensing optical system on a front surface side thereof excluding the emission surface.

14. The vehicular lamp according to claim 3, comprising an extension member configured to cover the second condensing optical system on a front surface side thereof excluding the emission surface.

15. The vehicular lamp according to claim 4, comprising an extension member configured to cover the second condensing optical system on a front surface side thereof excluding the emission surface.

16. The vehicular lamp according to claim 7, comprising an extension member configured to cover the second condensing optical system on a front surface side thereof excluding the emission surface.

17. The vehicular lamp according to claim 12, wherein the extension member has a slit portion extending in the first direction, and the protruding portion is inserted inside the slit portion.

18. The vehicular lamp according to claim 13, wherein the extension member has a slit portion extending in the first direction, and the protruding portion is inserted inside the slit portion.

19. The vehicular lamp according to claim 16, wherein the extension member has a slit portion extending in the first direction, and the protruding portion is inserted inside the slit portion.

* * * * *